US005902216A

United States Patent [19]

Lee

[11] Patent Number: 5,902,216

[45] Date of Patent: May 11, 1999

[54] PEDAL-TYPE EXERCISER

[76] Inventor: Sunny Lee, No. 257-8, Chung-Cheng Rd., Tsao-Tun Chen, Nan-Tou Hsien, Taiwan

[21] Appl. No.: 09/100,279

[22] Filed: Jun. 19, 1998

[51] Int. Cl.[6] ..... A63B 21/00

[52] U.S. Cl. ..... 482/57; 482/51

[58] Field of Search ..... 482/51–53, 57, 482/148, 63, 70; 601/23, 27, 34–36

[56] References Cited

U.S. PATENT DOCUMENTS

| | | | |
|---|---|---|---|
| 4,643,419 | 2/1987 | Hyde | 482/52 |
| 4,779,863 | 10/1988 | Yang | 482/51 |
| 4,786,050 | 11/1988 | Geschwender | 482/51 |
| 5,387,167 | 2/1995 | Johnston | 482/57 |
| 5,403,255 | 4/1995 | Johnston | 482/57 |
| 5,779,599 | 7/1998 | Chen | 482/57 |

*Primary Examiner*—Stephen R. Crow
*Attorney, Agent, or Firm*—Renner, Otto, Boisselle & Sklar, P.L.L.

[57] ABSTRACT

A pedal-type exerciser includes a base, first and second drive assemblies, a transmission chain, a pair of elongate pedal members and an elastic cord unit. The base has front and rear end portions. The first drive assembly has a first horizontal axle mounted rotatably on the front end portion of the base, a first drive wheel mounted securely on the first horizontal axle, and a pair of first crank arms mounted securely on opposite ends of the first horizontal axle. The second drive assembly has a second horizontal axle mounted rotatably on the rear end portion of the base and horizontally spaced from the first horizontal axle, a second drive wheel mounted securely on the second horizontal axle, and a pair of second crank arms mounted securely on opposite ends of the second horizontal axle. The transmission chain is trained on the first and second drive wheels. Each of the elongate pedal members is mounted to a corresponding one of the first crank arms and a corresponding one of the second crank arms for moving with the first and second crank arms. The elastic cord unit is secured to the base and is connected to the pedal members for providing resistance to pedaling of the pedal members.

7 Claims, 9 Drawing Sheets

PEDAL-TYPE EXERCISER

BACKGROUND OF THE INVENTION

1. Field of the Invention

This invention relates to a pedal-type exerciser, more particularly to a pedal-type exerciser that has elastic cord means serving as a resistance device.

2. Description of the Related Art

Referring to FIG. 1, a conventional pedal-type exerciser is shown to comprise a base 10 which has a front end portion that is provided with an upright prop 14, and a drive assembly which includes a horizontal axle 100 mounted rotatably on a rear end portion of the base 10, a drive wheel 12 mounted securely and coaxially on the axle 100, and a pair of crank arms 13 mounted securely on opposite ends of the axle 100. A flywheel 11 is mounted on the base 10 and is coupled to the drive wheel 12 for providing resistance to rotation of the axle 100. Each of a pair of elongate lever arms 16 has an intermediate portion mounted pivotally on a respective one of two horizontal pivot shafts 15 that are provided on opposite sides of the upright prop 14. Each of a pair of elongate pedal members 17 has a front portion mounted pivotally on a lower portion of a corresponding one of the lever arms 16, and a rear portion mounted pivotally on a distal end of a corresponding one of the crank arms 13. In use, the user's feet rest on the pedal members 17 while the user's hands grip the upper portions of the lever arms 16. The lever arms 16 are operated to pivot reciprocatingly on the base 10, and the pedal members 17 are alternatingly raised and lowered, thereby resulting in an exercising effect.

The drawbacks of the aforementioned pedal-type exerciser include the following: The flywheel 11 is bulky and heavy, thereby resulting in inconvenience during transport and storage of the conventional pedal-type exerciser. In addition, the user has to exert a large amount of force to ensure continued rotation of the drive wheel 12 when the crank arms 13 approach their respective dead zones. The uneven force requirement increases user discomfort and results in non-smooth operation of the conventional pedal-type exerciser.

SUMMARY OF THE INVENTION

The object of the present invention is to provide a pedal-type exerciser having a resistance device that is compact and lightweight in order to facilitate transport and storage.

Another object of the present invention is to provide a pedal-type exerciser that is relatively comfortable to use and which can be operated in a relatively smooth manner.

According to the present invention, a pedal-type exerciser comprises:

a base having a front end portion and a rear end portion;

a first drive assembly having a first horizontal axle mounted rotatably on the front end portion of the base, a first drive wheel mounted securely on the first horizontal axle, and a pair of first crank arms mounted securely on opposite ends of the first horizontal axle;

a second drive assembly having a second horizontal axle mounted rotatably on the rear end portion of the base and horizontally spaced from the first horizontal axle, a second drive wheel mounted securely on the second horizontal axle, and a pair of second crank arms mounted securely on opposite ends of the second horizontal axle;

a transmission chain trained on the first and second drive wheels;

a pair of elongate pedal members, each of which is mounted to a corresponding one of the first crank arms and a corresponding one of the second crank arms for moving with the first and second crank arms; and elastic cord means secured to the base and connected to the pedal members for providing resistance to pedaling of the pedal members.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
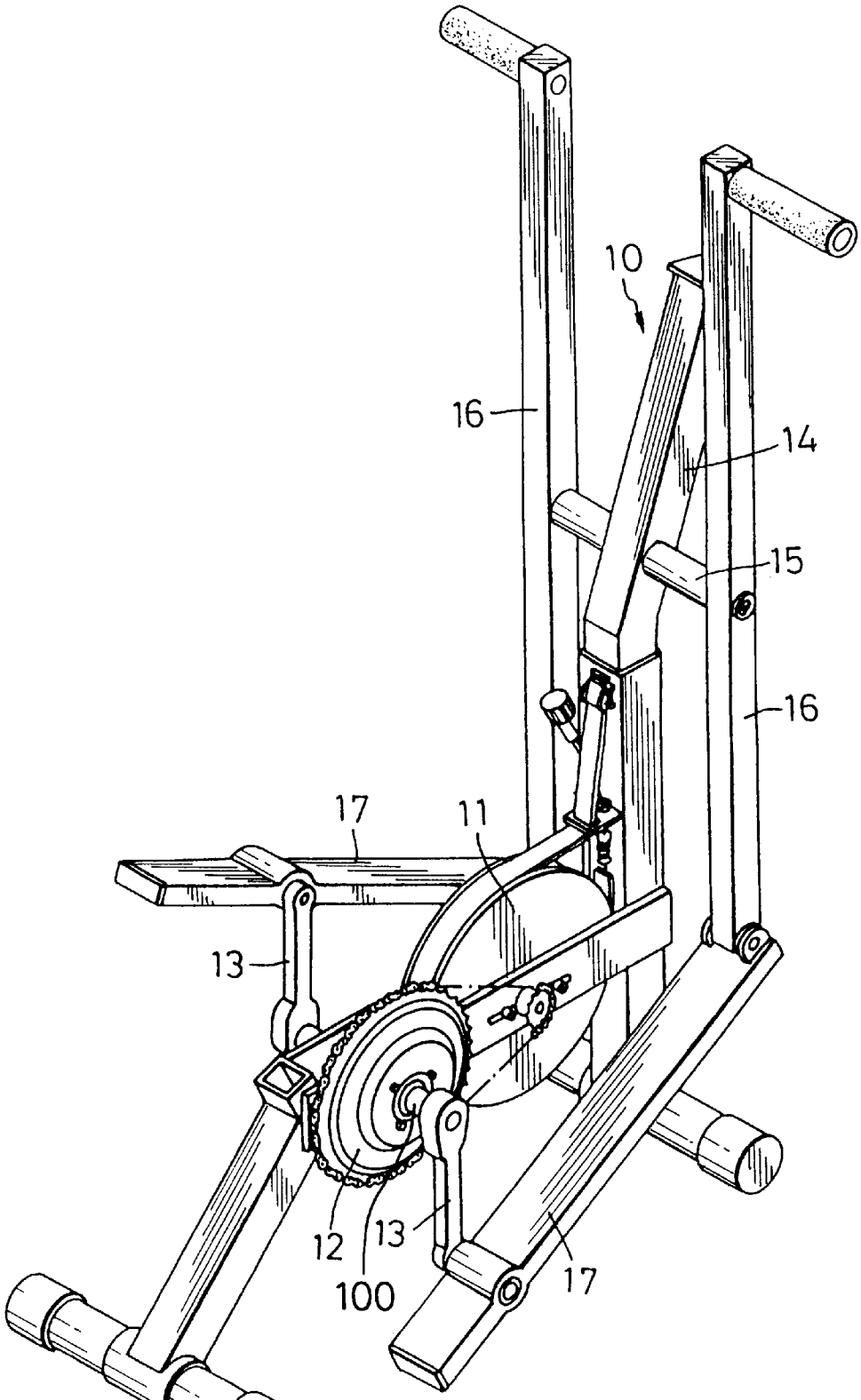
FIG.1 PRIOR ART
FIG. 1 is a perspective view of a conventional pedal-type exerciser.
Figure 2:
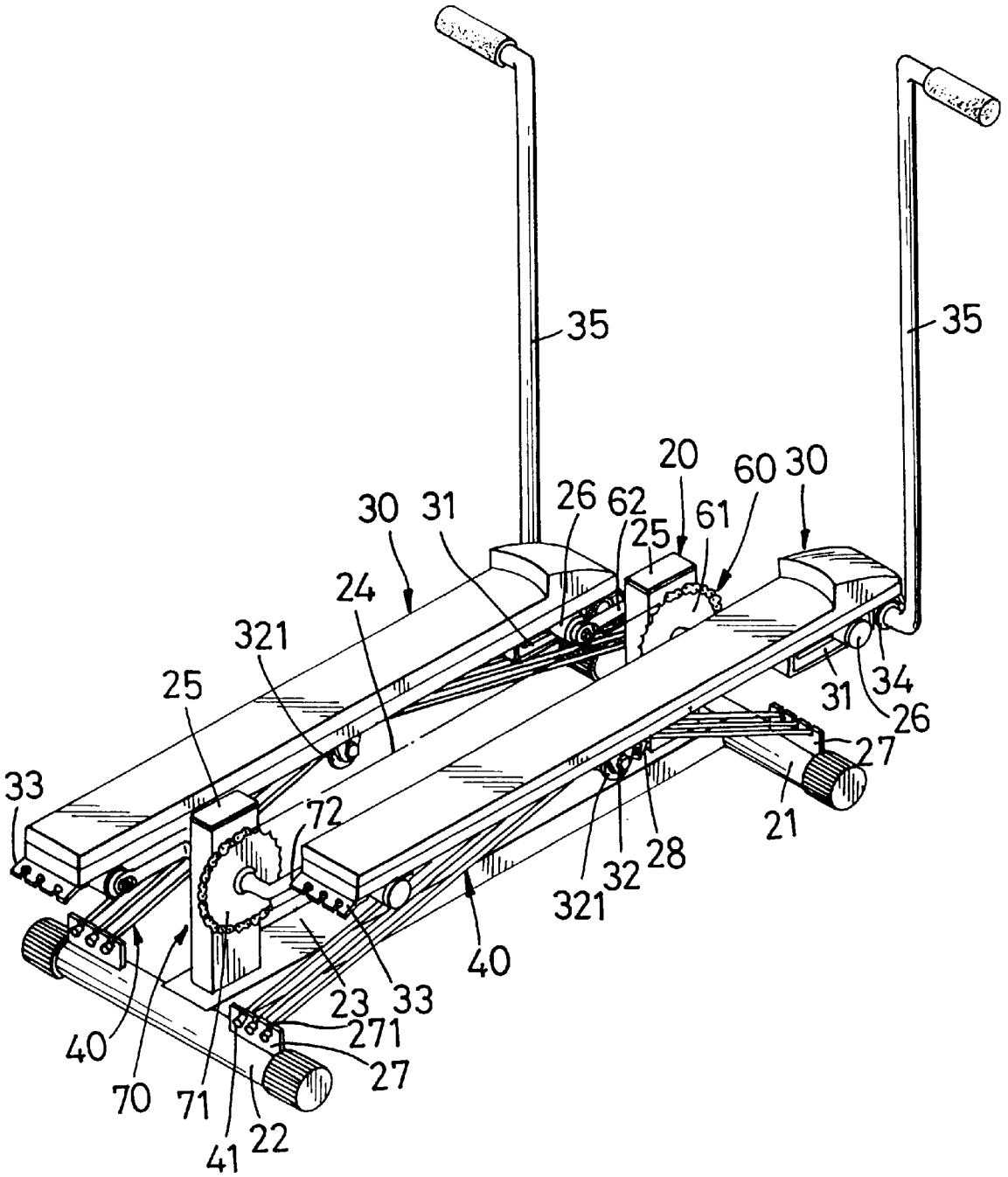
FIG. 2 is a perspective view of a preferred embodiment of a pedal-type exerciser according to the present invention.
Figure 3:
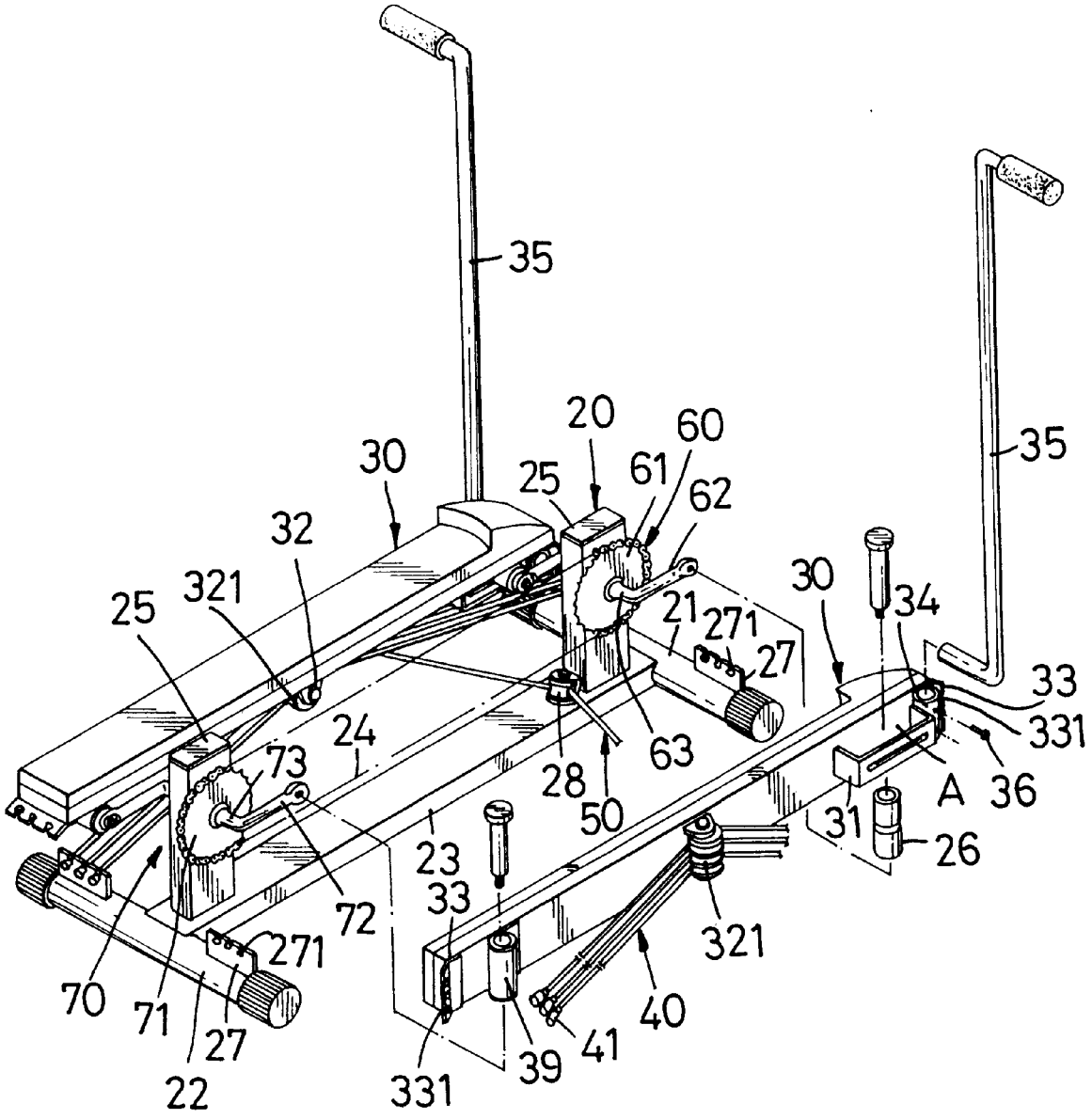
FIG. 3 is an exploded view of the preferred embodiment.
Figure 4:
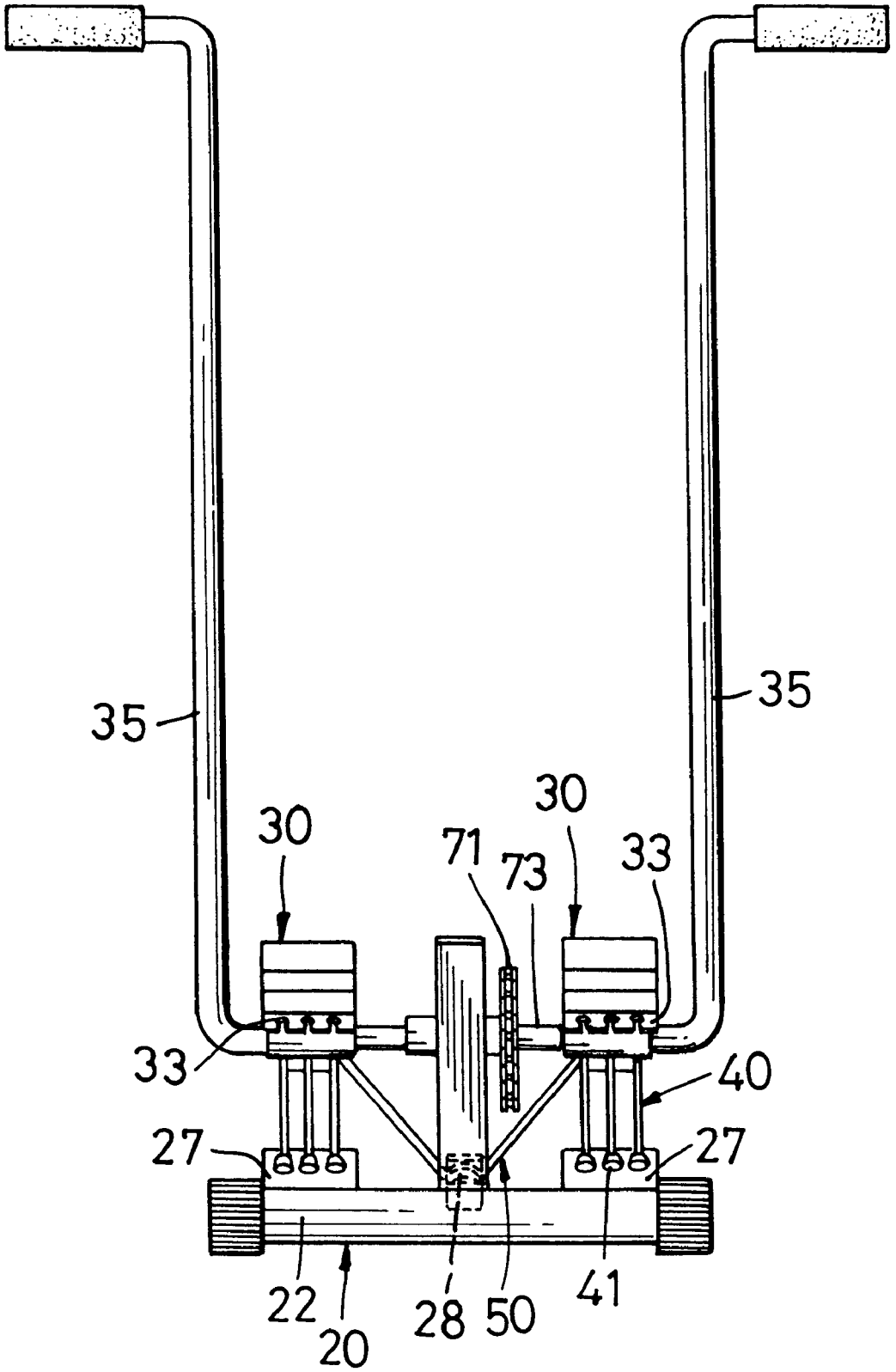
FIG. 4 is a schematic rear view of the preferred embodiment.

Referring to FIGS. 2, 3 and 4, a preferred embodiment of a pedal-type exerciser according to the present invention is shown to comprise a base 20, a first drive assembly 60, a second drive assembly 70, a pair of elongate pedal members 30 and elastic cord means.

The base 20 is generally I-shaped and is adapted to be supported on the ground surface. The base 20 has a front end portion 21, a rear end portion 22 and a connecting rod 23 interconnecting the front and rear end portions 21, 22. Front and rear upright stands 25 are provided on the connecting rod 23 adjacent to the front and rear end portions 21, 22, respectively.

The first drive assembly 60 includes a first horizontal axle 63 mounted rotatably on the front upright stand 25, a first drive wheel 61 mounted securely on the first horizontal axle 63, and a pair of first crank arms 62 mounted securely on opposite ends of the first horizontal axle 63.

The second drive assembly 70 includes a second horizontal axle 73 mounted rotatably on the rear upright stand 25 and horizontally spaced from the first horizontal axle 63, a second drive wheel 71 mounted securely on the second horizontal axle 73, and a pair of second crank arms 72 mounted securely on opposite ends of the second horizontal axle 73. A transmission chain 24 is trained on the first and second drive wheels 61, 71.

Each of the elongate pedal members 30 has a front portion with a distal end of a corresponding one of the first crank arms 62 mounted pivotally and slidably therealong, and a rear portion mounted pivotally on a distal end of a corresponding one of the second crank arms 72 for moving along with the first and second crank arms 62, 72. In this embodiment, each of the first crank arms 62 has a roller 26 mounted rotatably on the distal end thereof. The front portion of each of the pedal members 30 has a bottom side with a longitudinal rail member 31 mounted thereto, thereby forming a longitudinal rail groove (A) through the opposed side faces of the pedal members 30. The rail groove (A) rollingly receives the roller 26 on the corresponding one of the first crank arms 62. The front portion of each of the pedal members 30 has an upright handle member 35 connected thereto. The lower end of each of the handle members 35 is inserted into a sleeve member 33 which is fixed to the bottom side of the front portion of a corresponding one of the pedal members 30, and is fastened to the sleeve member 33 by means of a bolt member 36.

As shown in FIG. 3, the rear portion of each of the pedal members 30 has a bottom side provided with a coupling sleeve 39 for mounting pivotally on the distal end of the corresponding one of the second crank arms 72. As such, pedaling of the pedal members 30 can result in synchronous rotation of the first and second drive wheels 61, 71. Preferably, the first and second crank arms 62, 72 are arranged such that the pedal members 30 are maintained at a substantially horizontal position with respect to the ground surface.

The front and rear end portions 21, 22 of the base 20 have three first retaining members 27 fixed thereon on either side of the connecting rod 23. Each of the first retaining members 27 has three elongate notches 271 formed in a top edge thereof. A pulley member 28 is mounted to the front upright stand 25 of the base 20.

Each of the pedal members 30 has a pulley coupling seat 32 connected to the bottom face thereof, and three pulleys 321 mounted rotatably to the pulley coupling seat 32. Each of the front and rear portions of the pedal members 30 has a second retaining member 33 fixed thereto. The second retaining member 33 has three elongate notches 331.

Figure 7:
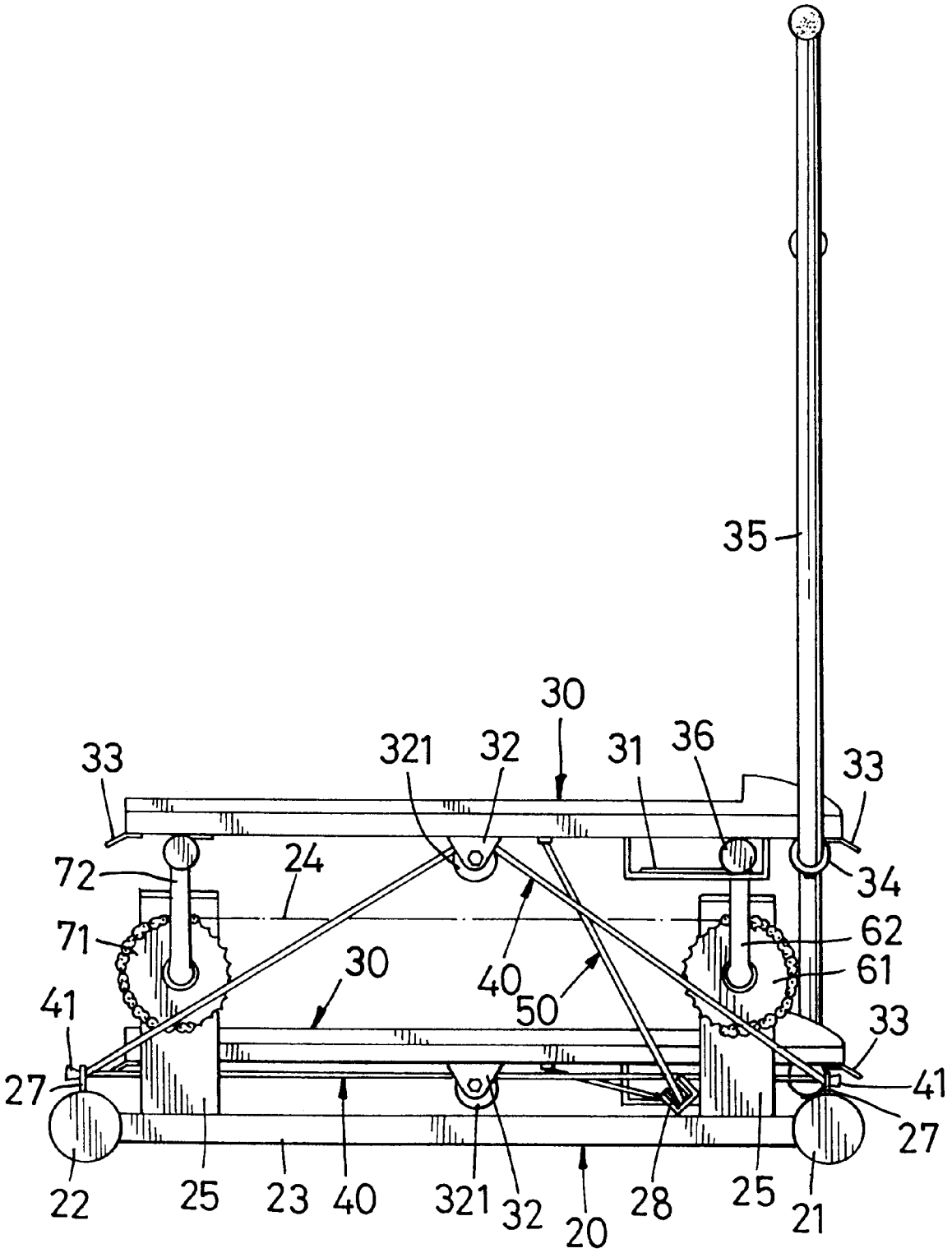
FIGS. 7 and 8 illustrate the operation of the preferred embodiment.
Figure 8:
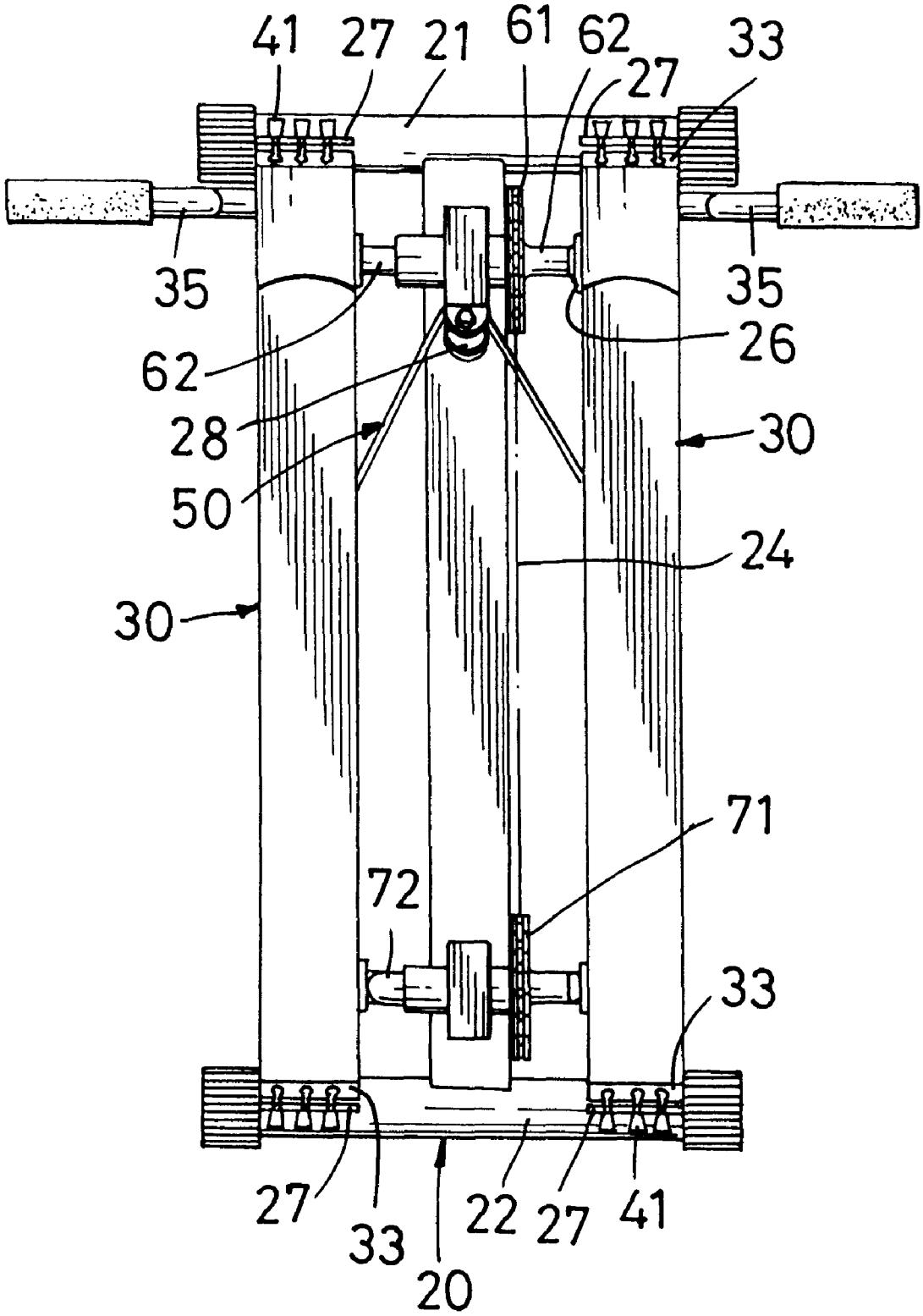

The elastic cord means is secured to the base 20 and is connected to the pedal members 30 for providing resistance to pedaling of the pedal members 30. More specifically, the elastic cord means includes a first elastic cord 50 and six second elastic cords 40. The first elastic cord 50 passes over the pulley member 28 and has two ends connected respectively to the pedal members 30 to provide the pedal members 30 with a forward and downward resistance force. Therefore, when the first and second crank arms 62, 72 reach their dead zones, the forward and downward resistance force exerted by the first elastic cord 50 aids in the movement of the first and second crank arms 62, 72 past the respective dead zones, as best illustrated in FIGS. 7 and 8. As such, the need to exert a larger amount of force when the first and second crank arms 62, 72 approach their respective dead zones is obviated. Since the exertion of uneven forces is not required when the exerciser of this invention is in use, user discomfort can be reduced and smooth operation of the exerciser can be ensured. In addition, a resistance force is exerted on the pedal members 30 by the first elastic cord 50 when the pedal members 30 move upward and rearward.

Figure 5:
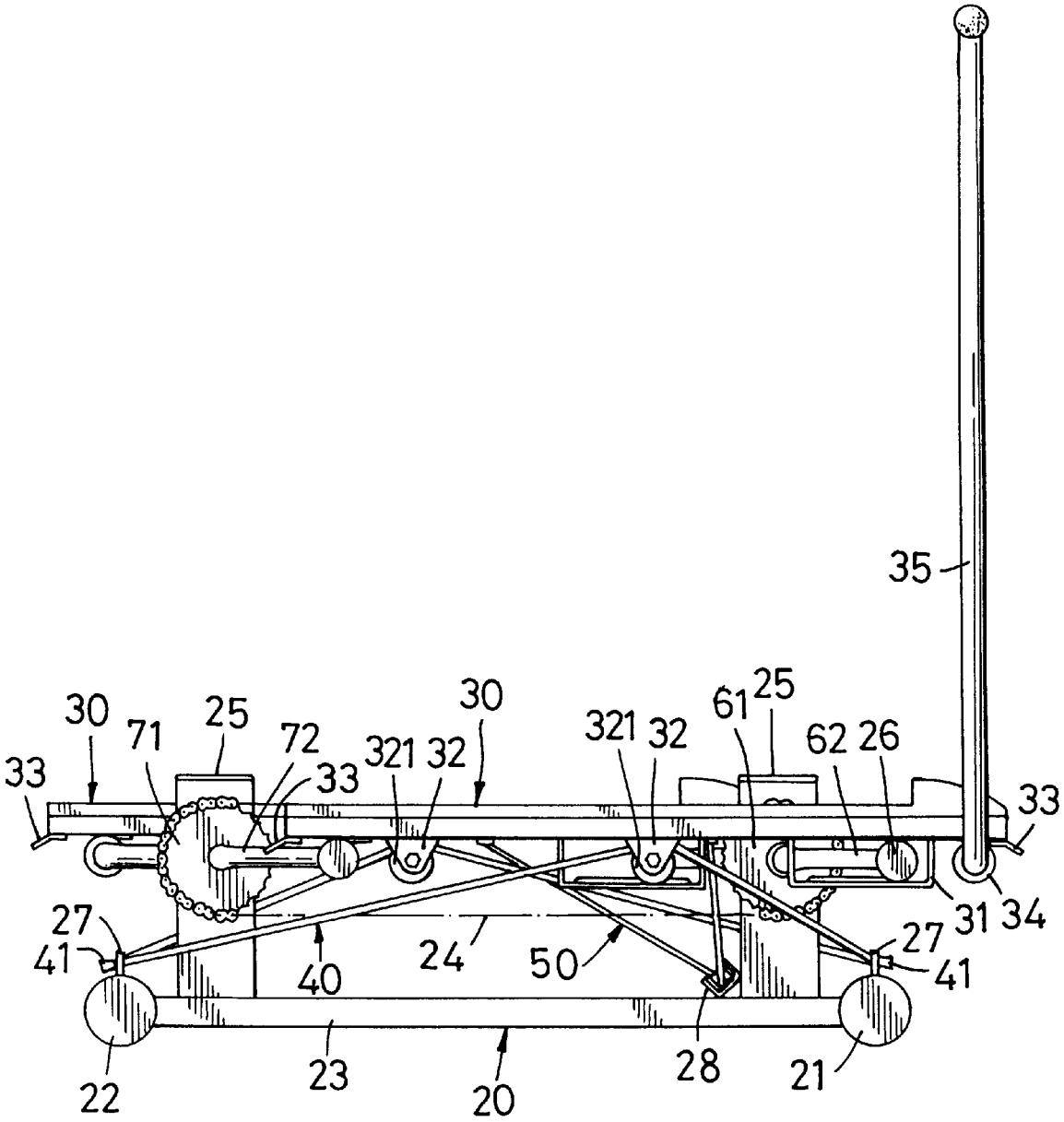
FIG. 5 is a schematic side view of the preferred embodiment.
Figure 6:
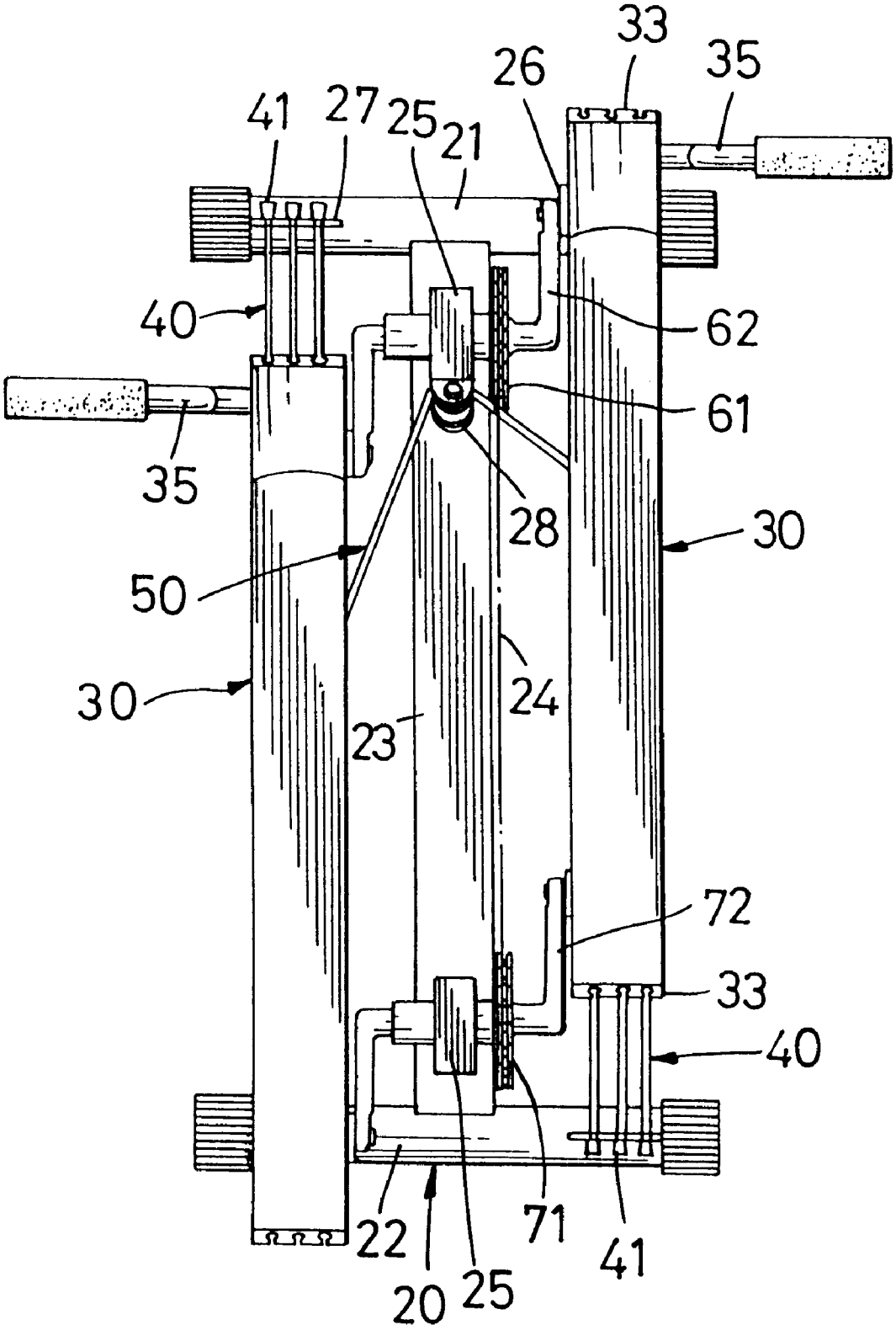
FIG. 6 is a schematic top view of the preferred embodiment.

Each of the second elastic cords 40 passes a respective one of the pulleys 321 on the pedal members 30 and has first and second enlarged ends 41 retained respectively by the notches 271 in the front and rear end portions 21, 22 of the base 20. When the exerciser is not in use, i.e., the pedal members 30 are in a static state, a force of the same level is exerted on either one of the pedal members 30 by the second elastic cords 40. Therefore, the pedal members 30 are located on the same level to make it easier for the user to step on the pedal members 30 before pedaling the same, as best illustrated in FIGS. 5 and 6. When the user pedals the pedal members 30, a resistance force is exerted on one pedal member 30 by the second elastic cords 40 as the other pedal member 300 is pedaled downward to raise said one pedal member 30, thereby resulting in an exercising effect for the user, as best illustrated in FIGS. 7 and 8.

It is noted that the elastic cord means of the exerciser of this invention occupies a relatively small amount of space and is lightweight as compared to the flywheel of the aforementioned conventional pedal-type exerciser. Therefore, the exerciser of this invention is relatively convenient to transport and store.

Figure 9:
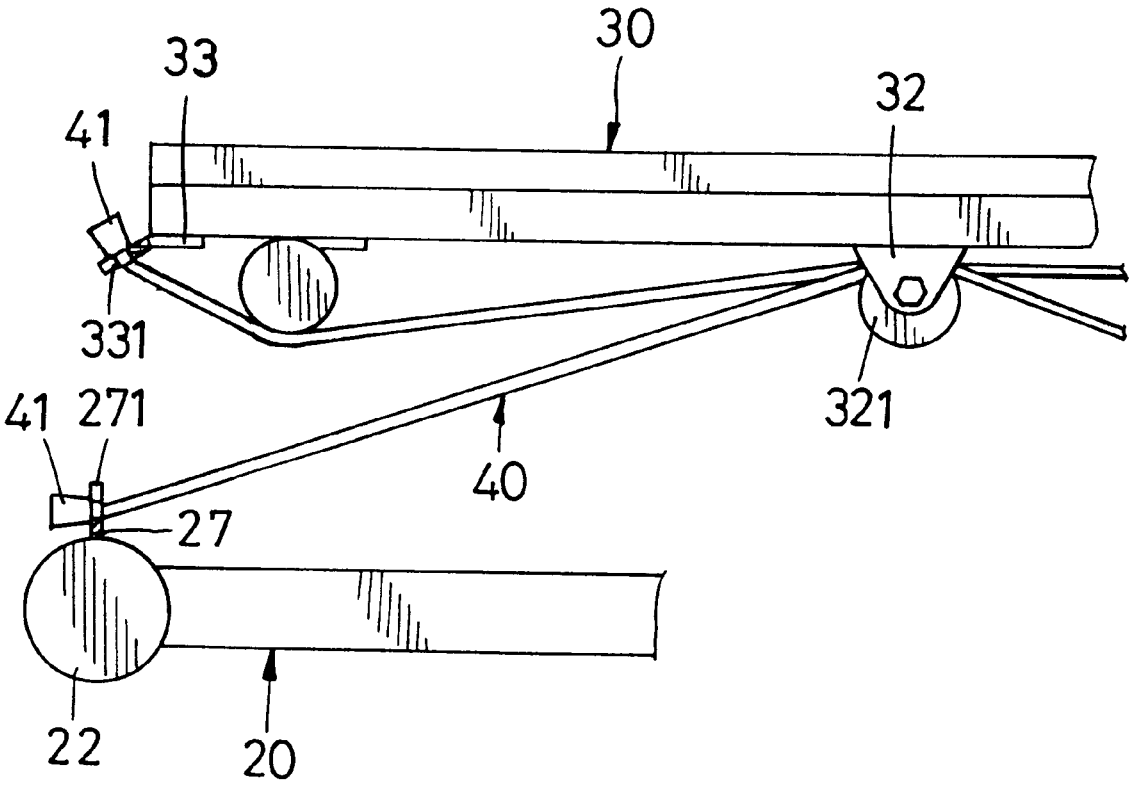
FIG. 9 is a schematic view illustrating how the resistance of the elastic cord means of the preferred embodiment is adjusted.

With reference to FIG. 9, when it is desired to reduce the resistance force exerted on the pedal members 30, the first and second ends of at least one of the second elastic cords 40 are detached from the notches 271 in the first retaining members 27 for engaging respectively the notches 331 in the second retaining members 33 on the front and rear portions of the pedal members 30.Therefore, by varying the number of the second elastic cords 40 that engage the first retaining members 27 of the base 20, the resistance force exerted on the pedal members 30 can be adjusted.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A pedal-type exerciser, comprising:

a base having a front end portion and a rear end portion;

a first drive assembly having a first horizontal axle mounted rotatably on said front end portion of said base, a first drive wheel mounted securely on said first horizontal axle, and a pair of first crank arms mounted securely on opposite ends of said first horizontal axle;

a second drive assembly having a second horizontal axle mounted rotatably on said rear end portion of said base and horizontally spaced from said first horizontal axle, a second drive wheel mounted securely on said second horizontal axle, and a pair of second crank arms mounted securely on opposite ends of said second horizontal axle;

a transmission chain trained on said first and second drive wheels;

a pair of elongate pedal members, each of which is mounted to a corresponding one of said first crank arms and a corresponding one of said second crank arms for moving with said first and second crank arms; and elastic cord means secured to said base and connected to said pedal members for providing resistance to pedaling of said pedal members.

2. The pedal-type exerciser as claimed in claim 1, wherein said front end portion of said base has a pulley member mounted thereto, said elastic cord means including a first elastic cord passing over said pulley member and having two ends that extend upward and rearward to connect respectively with said pedal members to provide said pedal members with a forward and downward resistance force.

3. The pedal-type exerciser as claimed in claim 1, wherein each of said pedal members has a bottom face and a plurality of pulleys mounted to said bottom face thereof, said elastic cord means including a plurality of second elastic cords passing respectively over said pulleys of said pedal members, each of said second elastic cords having a first end connected detachably to said front end portion of said base and a second end connected detachably to said rear end of said base.

4. The pedal-type exerciser as claimed in claim 2, wherein each of said pedal members has a bottom face and a plurality of pulleys mounted to said bottom face thereof, said elastic cord means further including a plurality of second elastic cords passing respectively over said pulleys of said pedal members, each of said second elastic cords having a first end connected detachably to said front end portion of said base and a second end connected detachably to said rear end of said base.

5. The pedal-type exerciser as claimed in claim 3, wherein said front and rear end portions of said base have first retaining members for holding detachably said first and second ends of said second elastic cords.

6. The pedal-type exerciser as claimed in claim 5, wherein each of said pedal members has second retaining members to releaseably and selectively hold said first and second ends of at least one of said second elastic cords when detached from said first retaining members of said base.

7. The pedal-type exerciser as claimed in claim 1, wherein each of said pedal members has an upright handle member connected thereto.

* * * * *